US006040805A

United States Patent [19]

Huynh et al.

[11] Patent Number: 6,040,805

[45] Date of Patent: Mar. 21, 2000

[54] LOW PROFILE CERAMIC CHOKE

[75] Inventors: Son Huy Huynh; George Cheng, both of Torrance, Calif.

[73] Assignee: Antcom Corp., Torrance, Calif.

[21] Appl. No.: 09/075,009

[22] Filed: May 8, 1998

[51] Int. Cl.[7] ..... H01Q 13/00

[52] U.S. Cl. ..... 343/785; 343/872; 343/873

[58] Field of Search ..... 343/770, 771, 343/776, 785, 786, 872, 873, 909; H01Q 13/00

[56] References Cited

U.S. PATENT DOCUMENTS

| | | | |
|---|---|---|---|
| 2,413,085 | 12/1946 | Tiley | 343/785 |
| 3,434,774 | 3/1969 | Miller | 343/785 |
| 4,546,459 | 10/1985 | Congdon | 367/155 |
| 5,434,585 | 7/1995 | Harris | 343/786 |

*Primary Examiner*—Don Wong
*Assistant Examiner*—Tho Phan
*Attorney, Agent, or Firm*—Roger A. Marrs

[57] ABSTRACT

A low profile ceramic choke for global positioning antenna systems having a ceramic ring with a plurality of concentric segments arranged in coaxial relationship about a center occupied by a circular antenna. The segments are spaced apart from each other and may be housed in a metal enclosure. The top surface of the ceramic ring and the enclosure are of frustro-conical configuration to provide for moisture elimination. The choke is less bulky and is smaller in size and the use of ceramic as a high dielectric constant material promotes fabrication by molding and mass production techniques.

10 Claims, 1 Drawing Sheet

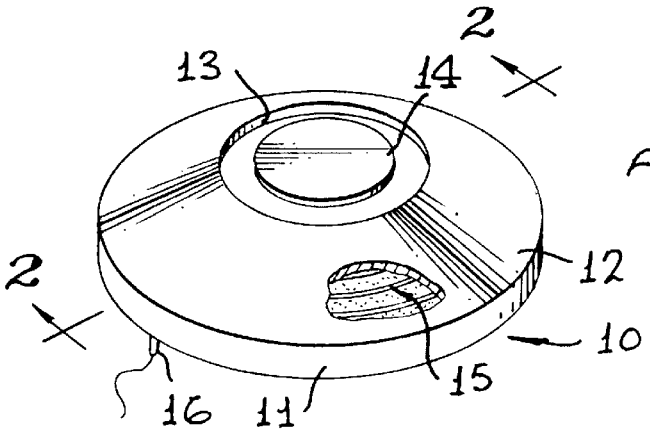
FIG. 1
FIG. 3
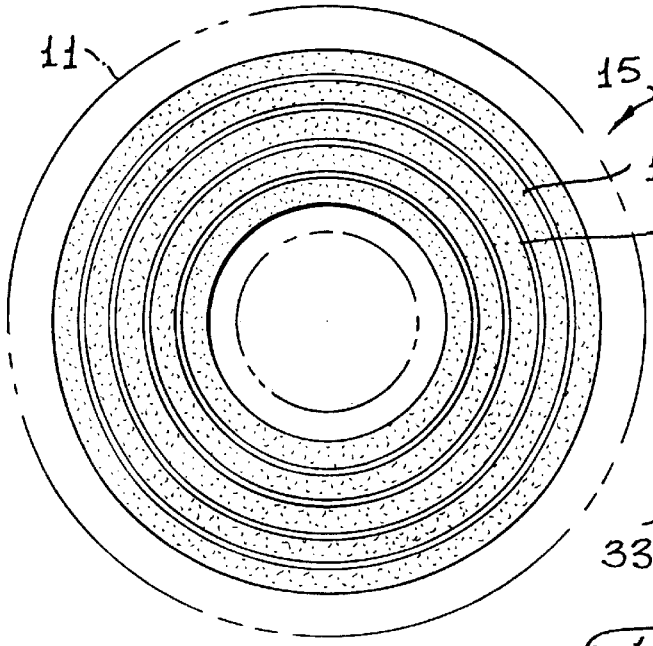
FIG. 4
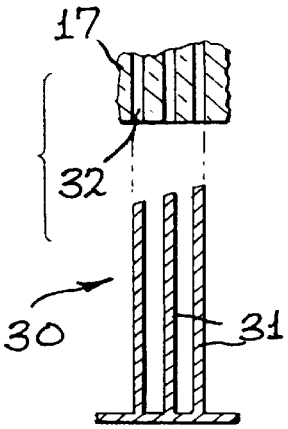
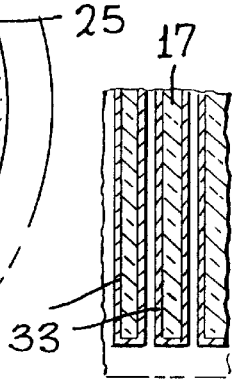
FIG. 5
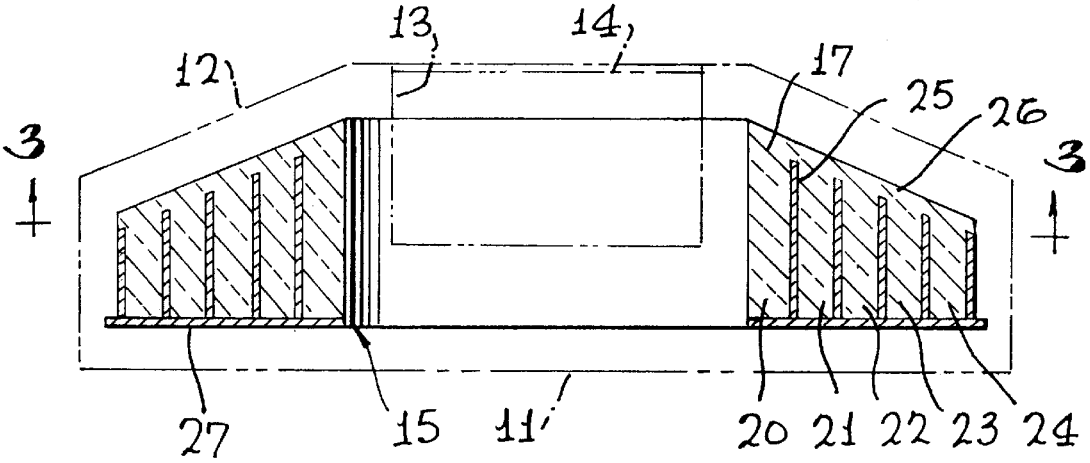
FIG. 2

LOW PROFILE CERAMIC CHOKE

BACKGROUND OF THE INVENTION

1. Field of the Invention

The present invention relates to the field of antenna receiving systems, and more particularly to a novel low profile ceramic choke for global positioning system antennas which is small in size, economical and may be readily mass produced.

2. Brief Description of the Prior Art

In the past, it has been the conventional practice to provide a filter reactor such as a coil or choke serving as an inductance in antenna systems. For example, a global positioning antenna is employed to receive signals which determine the location in longitude and latitude of the receiving system. In such highly precision navigational and surveying applications, the receiving antenna includes a choke slot ground plane incorporated with the receiving antenna in order to reduce phase error. The choke slot ground plane provides a highly capacitive surface that cannot support surface currents. This reduces re-radiation of these currents which in turn adds to the reduction of multi-path errors. Also, the choke slot ground plane allows the antenna to receive a cleaner signal and thus increase location accuracy.

Problems and difficulties have been encountered with conventional antenna chokes since the chokes are composed of metal and are bulky, large in size and, therefore, expensive to fabricate. Fabrication also includes or requires machining. A circular block of metal is machined so as to provide a plurality of concentric walls or ring-like partitions that are integral with a bottom support plate. The opposite side of the construction is open so that a plurality of alternate open spaces are defined between a plurality of different sized concentric thin cylindrical walls. In this manner, the air provides the dielectric between opposing surfaces of the concentric walls and an antenna is supported in the central area having the concentric walls of the choke surrounding the antenna. In order to provide for moisture or humidity protection, a plurality of holes is placed in the support plate so that drainage may be accommodated. Each circular gap or space between adjacent circular walls includes at least one, and preferably, multiple openings in the support plate to provide drainage. Furthermore, the conventional choke may further include a housing which is open in the center in order to expose the antenna while covering the circular choke.

Not only does the aforementioned conventional choke represent a bulky and expensive device to manufacture, but the collection and disposal of moisture within the air gaps of the choke adversely affects the efficiency and performance of the antenna. Also, the collection of moisture on the concentric and spaced-apart walls adversely affects heat dissipation and sometimes requires the expensive and costly necessity of hermetically sealing the metal housing. The ground plate may include holes for drainage in conventional chokes; however, these may clog and prevent drainage.

Therefore, a long-standing need has existed to provide a low profile ceramic choke for global positioning antenna application which is smaller in size than conventional chokes and which is lower cost and may readily be mass-produced without requiring machining and expensive materials.

SUMMARY OF THE INVENTION

Accordingly, the above problems and difficulties are avoided by the present invention which provides a novel low profile ceramic choke for global positioning system antenna applications comprising a circular ring of ceramic material having a central opening for placement of an antenna intended to receive frequencies in the megahertz range. The ceramic ring is provided with a plurality of concentric slots of different diameters which are occupied by a metal such as copper or the like. The metal in the slots is integrally joined together on a plated backing which is composed of copper and the backing takes the form of a metallic choke ring at the bottom of the ceramic ring. The top of the ceramic ring is continuous and the plurality of different sized slots terminates short of the top of the ceramic ring so that each of the respective sections of ceramic between adjacent slots is joined along the top of the ceramic ring.

In one form of the invention, a housing may be provided for supporting the antenna and the ceramic choke in coaxial relationship and the housing and choke may include a tapered or sloping top side which promotes moisture runoff collected by rain, humidity or the like.

Therefore, it is among the primary objects of the present invention to provide a novel choke for global positioning system antennas which may be manufactured in a mass-produced manner at an economical and low cost relationship.

Another object of the present invention is to provide a low profile ceramic choke which is small in size as compared to conventional antenna chokes and which may be manufactured at a low cost employing mass-production techniques and fabrication methods.

Still a further object of the present invention is to provide a low profile ceramic choke which incorporates means for eliminating moisture collection due to rain or humidity conditions such that the detrimental effects of humidity and moisture are avoided and good heat dissipation is provided.

An object resides in forming a circular choke with a plurality of concentric spaced-apart slots that may insertably receive a metal insert into each slot or each slot may receive a metal plated coating or layer whereby the choke may be mass produced at a low cost.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a reduced perspective view of the novel low profile ceramic choke incorporating the present invention;

FIG. 2 is an enlarged transverse cross-sectional view of the choke and antenna illustrated in FIG. 1 as taken in the direction of arrows 2—2 thereof;

FIG. 3 is a longitudinal cross-sectional view of the choke and antenna shown in FIG. 2 as taken in the direction of arrows 3—3 thereof;

FIGS. 4 and 5 are enlarged fragmentary views of alternate insertion and plating techniques used in producing the inventive choke.

DESCRIPTION OF THE PREFERRED EMBODIMENT

Referring to FIG. 1, the novel low profile ceramic choke for use in connection with a global positioning system antenna is illustrated in the general direction of arrow 10 which includes a housing 11 having a tapered upper surface 12 and a central opening 13 which exposes a conventional antenna 14. A portion of the top surface 12 has been broken away to expose the ceramic choke, broadly indicated by numeral 15. A suitable connector 16 couples the antenna to suitable receiving circuits.

Referring now in detail to FIG. 2, it can be seen that the choke 15 comprises a ring composed substantially of a dielectric material such as ceramic and the ceramic dielectric is indicated by numeral 17. During manufacturing, the ceramic ring 15 may be produced in a mold as a one-piece or unitary configuration having a plurality of segments such as inner segment 20, segment 21, segment 22, segment 23, and outer segment 24. The respective segments are separated by a circular slot which may provide an air gap but is preferably occupied by a spacer or a wall such as a metal barrier 25 disposed between adjacent segements 21 and 22. In this manner, a plurality of ceramic rings of different diameters is provided which are coaxially disposed with respect to one another and in coaxial relationship with respect to the antenna 14 and the housing 11. Preferably, the ceramic choke 15 is of one-piece construction whereby the various segments 20–24 inclusive are joined together by a top edge marginal region, represented by numeral 26. A copper plating ring 27 is attached to the underside of the ceramic ring 15.

FIG. 3 illustrates that the various ceramic segments are coaxially disposed with respect to one another and that the various segments are separated by the air gap or barrier, indicated by numeral 25.

In FIGS. 2 and 3, it can be seen that the ceramic ring as well as the antenna 14 may be housed within the enclosure or housing 11 and that the upper surface 12 is downwardly tapering from the opening 13 towards the outside edge of the housing. This construction permits ready draining of any water that collects or gathers on the surface 12.

In view of the foregoing, it can be seen that the entire choke 10 is composed of a dielectric taking the form of a ceramic composition or any high dielectric constant materials. The high dielectric materials electrically and mechanically reduce the overall size of the choke as compared to conventional chokes. The underside of the choke may be metallized to simulate the metallic cylindrical shell which is commonly used. The choke can be produced in large quantities using molding, plating and other mass-production techniques. Since no machining is required, as in the case of prior art chokes employing solid metal construction, and since ceramic materials are inexpensive, the choke ground planes can be mass-produced at a low cost.

As an example, a preformed metal insert 30, shown in FIG. 4, may be made in one-piece and subsequently introduced to the ceramic ring 17 by aligning the metal walls 31 with slots 32 formed in the ceramic ring 17 followed by insertion of the metal walls into the slots. Alternately, as shown in FIG. 5, the metal formation or layers may be plated over the exposed surface of the slots and such plating layer is indicated by numeral 33. Also, the ring 27 may be plated onto the choke after either insertion of the walls or plating of the layers.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A low profile choke for a global positioning antenna system comprising:

a ring of high dielectric constant material having an open center and a circular peripheral edge;

a plurality of concentric segments forming said ring of high dielectric constant material providing a highly capacitive surface;

a metallized undersurface backing carried on said ring;

an antenna disposed in said open center of said ring; and an upper surface of said ring being tapered to provide moisture runoff.

2. The low profile choke defined in claim 1 wherein:

said concentric segments of different diameters and are arranged in coaxial relationship.

3. The low profile choke defined in claim 2 wherein:

said concentric segments are integrally formed and connected together by a top edge marginal region to provide a unitary construction.

4. The low profile choke defined in claim 3 including:

a metal housing surrounding said ring of high dielectric constant material and said housing having a top tapered surface.

5. The low profile choke defined in claim 4 wherein:

said high dielectric constant material is of ceramic composition having fabrication characteristics adapted to be formed in a mold.

6. A low profile choke for global positioning antenna systems comprising:

a ring of ceramic material constituting a high idelectric constant material;

an antenna located in the center of said ring so as to be flush with said ring;

said ring being integrally formed with a plurality of concentric segments in fixed spaced-apart relationship;

a bottom carried on said ring of metallized composition; and a top of said ring being of frustro-conical configuration to avoid collection of moisture.

7. The low profile choke defined in claim 6 wherein:

said ceramic material ring is of high dielectric density providing reduced thickness, low profile and decreased overall diameter.

8. A low profile choke for a global positioning antenna system comprising:

a ring of high dielectric constant material having an open center and a circular peripheral edge;

a plurality of concentric segments forming said ring of high dielectric constant material providing a highly capacitive surface;

a metallized undersurface backing carried on said ring;

said plurality of concentric segments are arranged in fixed spaced-apart relationship so as to define a slot or gap therebetween; and a metal formation occupying said slot or gap.

9. The low profile choke defined in claim 8 wherein:

said metal formation is a plated layer of metal composition.

10. The low profile choke defined in claim 8 wherein:

said metal formation is an insert of metal composition;

said insert includes a plurality of spaced-apart walls insertable into said slots or gaps.

* * * * *